United States Patent [19]

Ohkoshi et al.

[11] Patent Number: 4,529,905

[45] Date of Patent: Jul. 16, 1985

[54] CATHODE RAY TUBE APPARATUS

[75] Inventors: Akio Ohkoshi, Tokyo; Kiichi Ueno, Kanagawa; Tsuneo Muchi, Kanagawa; Tamihaura Masatoki, Kanagawa; Isamu Michiba, Kanagawa, all of Japan

[73] Assignee: Sony Corporation, Tokyo, Japan

[21] Appl. No.: 447,699

[22] Filed: Dec. 7, 1982

Related U.S. Application Data

[63] Continuation of Ser. No. 156,204, Jun. 3, 1980, abandoned.

[30] Foreign Application Priority Data

Jun. 7, 1979 [JP] Japan ..... 54-77465[U]

[51] Int. Cl.[3] ..... H01J 29/86; H01J 5/20

[52] U.S. Cl. ..... 313/35; 313/44; 313/45; 313/477 R; 358/245

[58] Field of Search ..... 313/477, 482, 478, 474, 313/12, 36, 44, 45; 358/245, 252, 255

[56] References Cited

U.S. PATENT DOCUMENTS

| | | | |
|---|---|---|---|
| 1,955,899 | 4/1934 | Zworykin | 313/36 X |
| 2,047,020 | 7/1936 | Flaherty | 313/482 X |
| 2,093,288 | 9/1937 | Ogloblinsky | 313/474 |
| 2,128,631 | 8/1938 | Eaton | 313/36 X |
| 2,348,825 | 5/1944 | Kratky | 313/22 X |
| 2,479,458 | 8/1949 | Barthelemy | 313/477 X |
| 3,384,162 | 5/1968 | Chan | 165/104.33 |
| 3,531,674 | 9/1970 | Spencer | 313/44 |
| 4,151,554 | 4/1979 | Tucker | 358/64 X |

FOREIGN PATENT DOCUMENTS

| | | | |
|---|---|---|---|
| 1462832 | 12/1968 | Fed. Rep. of Germany | 313/482 |

*Primary Examiner*—Palmer Demeo

*Attorney, Agent, or Firm*—Hill, Van Santen, Steadman & Simpson

[57] ABSTRACT

A cathode ray tube apparatus having a metal body with heat radiation effect which is located at least at a front periphery of a front panel of the cathode ray tube, a transparent panel located at the front of the front panel and facing the front panel with a predetermined distance therebetween, the metal body abutting the front periphery of the front panel and a periphery of the transparent panel to form a space therein; and transparent coolant sealed in the space.

4 Claims, 6 Drawing Figures

CATHODE RAY TUBE APPARATUS

This is a continuation of application Ser. No. 156,204, filed June 3, 1980, and now abandoned.

BACKGROUND OF THE INVENTION

1. Field of the Invention

The present invention relates generally to a cathode ray tube apparatus, and is directed more particularly to a cathode ray tube apparatus suitable for use with a high-brightness cathode ray tube used in, for example, a color projector.

2. Description of the Prior Art

In a prior art high-brightness cathode ray tube, the energy of an electron beam impinging on a phosphor screen is selected high to reproduce an optical image with high brightness. However, since the thermal conductivity of a front panel or glass panel, on which phosphor is coated, is low, upon especially continuous driving, it is difficult to diffuse or radiate heat and hence the temperature at the center of the panel is greatly increased. As a result, a so-called thermal quenching is caused in the phosphor. The thermal quenching is such a phenomenon that the brightness of the phosphor is lowered as the temperature is raised high. In this case, since the degree of the thermal quenching is different with the respective color phosphors, the white balance is disturbed. The disturbance of the white balance at the center of the phosphor screen results in that the picture quality is deteriorated remarkably. To avoid this, it may be considered that, in order to establish the white balance at the center of the panel, the brightness of other color phosphors is adjusted. This, however, results in that the white balance on the peripheral portion of the panel is disturbed and it becomes impossible to raise the brightness of the whole panel.

In order to avoid the increase in temperature on the front panel of the cathode ray tube which will cause the thermal quenching of the phosphor coated on the front panel, it is enough to provide a fan which will cool the surface of the panel. The fan, however, can introduce wind and dust to the panel surface to the panel surface. The dust then adheres to the panel surface to deteriorate the brightness thereof. The noise generated by the fan also proposes a problem.

To avoid the above defect, such an apparatus has been proposed, in which transparent cooling material or coolant such as convectable liquid is disposed in contact with the front surface of the panel to cool the front panel. The apparatus, however, is rather complicated in construction and is expensive.

OBJECTS AND SUMMARY OF THE INVENTION

Accordingly, an object of the present invention is to provide a cathode ray tube apparatus in which a coolant is made to effectively enhance the heat radiation with simple construction.

According to an aspect of the present invention a cathode ray tube apparatus is provided which comprises;

a metal body having heat radiation effect located at least at a front periphery of a front panel of said cathode ray tube;

a transparent panel located at the front of said front panel and facing said front panel with a predetermined distance therebetween, said metal body abutting the front periphery of said front panel and a periphery of said transparent panel to form a space therein; and transparent coolant sealed in said space.

The other objects, features and advantages of the present invention will become apparent from the following description taken in conjunction with the accompanying drawings through which the like references desitnate the same elements and parts.

DESCRIPTION OF THE PREFERRED EMBODIMENTS

The present invention will be hereinafter described with reference to the attached drawings.

Figure 1:
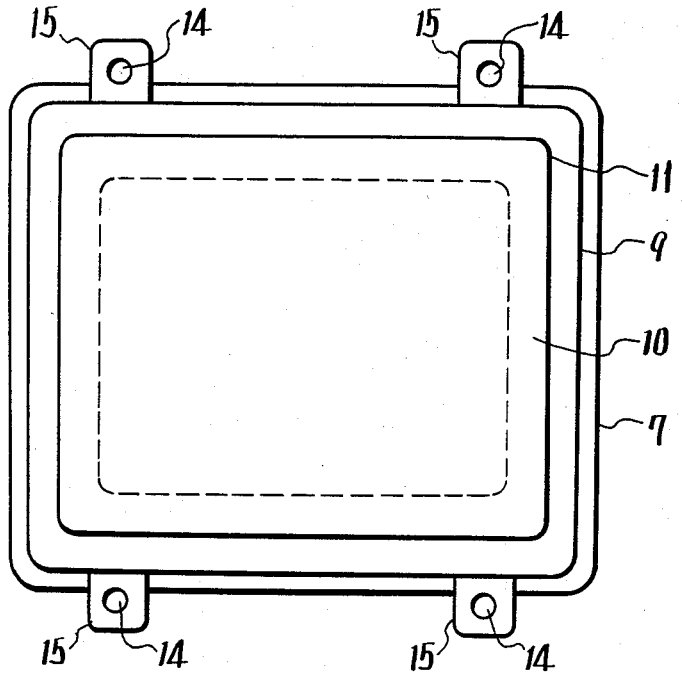
FIG. 1 is a front view showing an example of the cathode ray tube apparatus according to the present invention.
Figure 2:
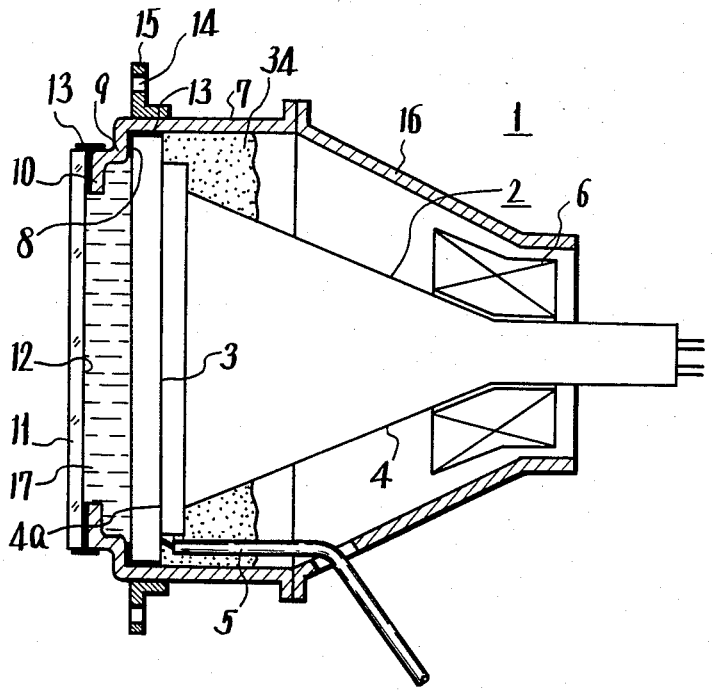
FIG. 2 is a side view showing, partially in cross-section, the example shown in FIG. 1.

Turning to FIGS. 1 and 2, a first example of the cathode ray tube apparatus according to the present invention will be now described. In the figures, 1 generally designates a cathode ray tube apparatus of the invention and 2 its cathode ray tube, respectively. In this example, the cathode ray tube 2 is a so-called flat panel type cathode ray tube, so that its panel 3 coated with a phosphor screen (not shown) on its inner surface is made of a flat glass plate. This panel 3 is frit-sealed to an opening end surface 4*a* of funnel 4 of tube 2. In the figures, 5 designates a high voltage supplying cable which is led out from the frit-seal portion between the panel 3 and funnel 4 and connected to a high voltage applying terminal (not shown), and 6 a horizontal and vertical deflection device. In this example, a metal body having a thermal diffusion effect is located as a spacer between the front panel 3 of cathode ray tube 2 and a transparent panel 11 apart from and in front of the panel 3 with a predetermined distance, and is contacted with a transparent coolant charged or sealed in the space between the front panel 3 and the transparent panel 11.

In the example of FIGS. 1 and 2, as the above metal spacer, a cylindrical metal cover 7, which is superior in shielding effect for the x-rays, is provided in such a manner that it surrounds the periphery of the cathode ray tube 2 and extends from the front peripheral portion of panel 3 to the rear portion in coaxial relationship with tube 2. The metal cover 7 is provided with an inwardly bent step 8 so as to abut against the front periphery of panel 3 of tube 2, a cylindrical portion 9 extends forwardly from the step 8 along the axis of tube 2, and a flange portion 10 extended at the front of cylindrical portion 9 in the direction to the axis of tube 2. This metal cover 7 may be formed by, for example, extraction molding. This metal cover 7 may be made of, for example, an iron plate coated with zinc whose surface is subjected to the darkening treatment or coated with black paint so as to increase heat radiation on the surface of the plate.

Against the outer surface of the flange portion 10 of metal cover 7, abutted is the transparent panel 11 which in turn faces the front panel 3 of tube 2 with a predetermined distance therebetween. Thus, a space 12 is formed, which is surrounded by the transparent panel 11, panel 3 of tube 2, the cylindrical portion 9 and flange portion 10 of metal cover 7. The space 12 is hermetically-sealed. To this end, adhesive sealing agent 13 such as silicone resin is charged between the transparent panel 11 and the flange portion 10 of metal cover 7 and coated on the outer periphery thereof to seal up the same. Similary, the adhesive sealing agent is charged into the portion between the periphery of the front portion of panel 3, its outer periphery and the inner surface of metal cover 7 to seal up the portion.

Into the space between the tube 2 and metal cover 7, charged is charging material 34 such as silicone resin or the like, if necessary.

An attaching piece 15 with an attaching bore 14 formed therethrough made of, for example, metal is fixed to the outer surface of metal cover 7 by welding or the like. When the cathode ray tube 2 is attached to a cabinet or other fixed members (not shown), a bolt is screwed through the bore 14 to the cabinet, if desired.

Coolant 17 is charged into the space 12. As the coolant 17, it is desired to use such a liquid which is transparent, effectively generates convection therein when heated higher than the room temperature or whose melting point m.p is lower than 0° C. and whose viscosity $\eta$ is low. Also, it is desired that the coolant 17 is selected from materials whose refractive index is near that of glass forming the panel 3. Further, the coolant 17 must be low in poisonous character, inexpensive and has electrical conductive property such as benzyl alcohol, methyl benzoate, ethyl benzoate, diethyl oxalate, dibuthyl phthalate, ethylene glycol, mixture thereof, mixture of water with each of them, mixture of them with water and so on.

The coolant 17, for example, cooling liquid is introduced into the space 12 through an aperture, which is not shown but provided through the cylindrical portion 9 of metal cover 7, and then the aperture is closed by, for example, a rubber plug and sealed by resin.

At the rear side of metal cover 7, provided is another cylindrical metal cover 16, which also has shielding effect for the X-rays to prevent the radiation of the unnecessary electromagnetic wave to the outside of the cathode ray tube 2 by the cooperation of metal covers 7 and 16.

According to the present invention constructed as above, the coolant 17 is provided in contact with the front surface of panel 3 of cathode ray tube 2, the cylindrical portion 9 of metal cover 7 and its flange 10, so that the heat generated in the panel 3 is conducted to the metal cover 7 through the coolant 17 and then to the metal cover 16. Therefore, the heat conducted to the metal covers 7 and 16 are effectively radiated outside from the wide outer surface thereof. In this case, when liquid is used as the coolant 17, if the temperature of panel 3 increases, the coolant 17 heated by the panel 3 moves upward to generate convection in the coolant 17. Therefore, even the heat generated at the center portion of panel 3 can be effectively conducted to the front cylindrical portion 9 and flange portion 10 of metal cover 7 which are located at the outer peripheral portion of metal cover 7. In this case, if the metal cover 7 is subject to such a treatment to present high heat radiation as described above, the heat conducted thereto can be effectively radiated.

As described above, the coolant 17 is disposed in contact with the panel 3 and the metal cover 7, which serves to shield the electromagnetic wave, is used to radiate the heat conducted thereto through the coolant 17, so that there is not introduced any complicated structure to perform the above purpose and the increase in temperature at the panel can be effectively avoided even if the apparatus is continuously used for long time of period.

Further, according to the present invention, the coolant 17 having electric conductivity is disposed in contact with the panel 3 of cathode ray tube 2 and the transparent panel 22, so that static charge can be easily discharged.

Also, when the charging agent 34 is disposed between the front outer periphery of tube 2 and metal cover 7 as described above, the insulation between the tube 2 and metal cover 7, especially the high voltage supplying terminal and metal cover 7 can be improved. Further, if such a material which is relatively high in heat conduction is employed as the charging agent 34, the heat at the panel 3 can be further effectively conducted to the metal cover 7 to increase the heat diffusion effect.

In fact, when the coolant 17 is heated by the heat from the panel 3, the volume of coolant 17 increases. However, since the sealing agent 13 of the closed space 12 is a sealing agent such as silicone resin or the like rich in elasticity, the expansion or shrinkage of coolant 17 can be absorbed or followed up by the expansion or shrinkage of the sealing agent 13.

Figure 3:
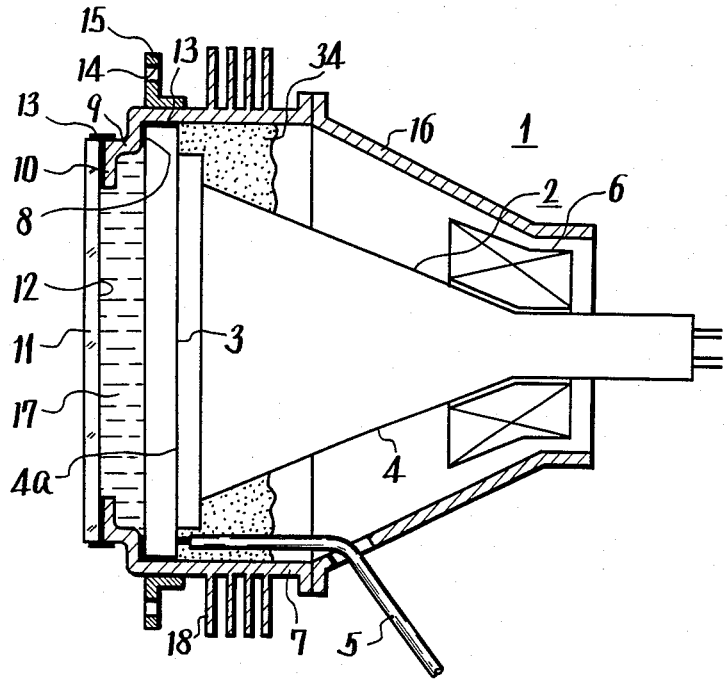
FIGS. 3 and 4 are respectively side views showing, partially in cross-section, other examples of the invention.
Figure 4:
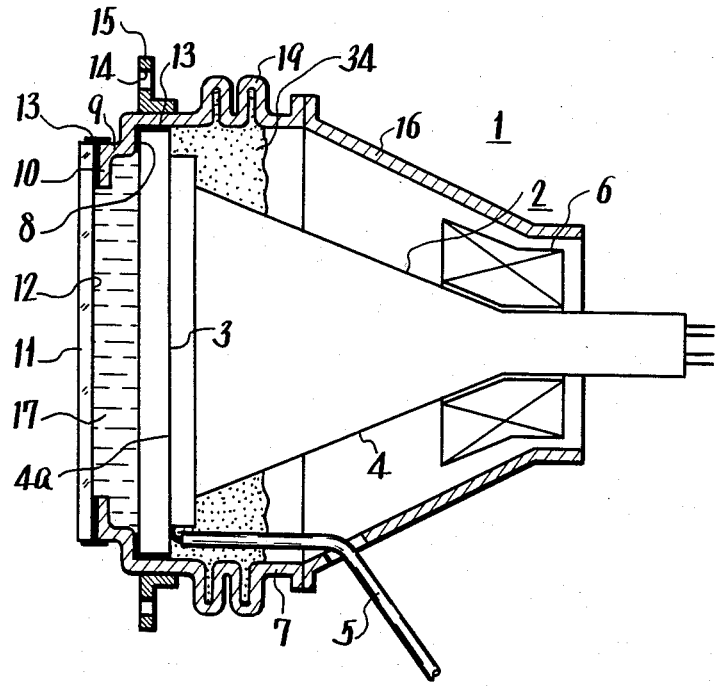

FIGS. 3 and 4 are diagrams respectively showing other examples of the invention. In the example of FIG. 3, ring-shaped fins 18 are attached to the outer periphery of metal cover 7 to enhance the heat radiation effect, and in the example of FIG. 4, corrugations 19 are formed on the cylindrical portion of metal cover 7 to also enhance the heat radiation effect.

Figure 5:
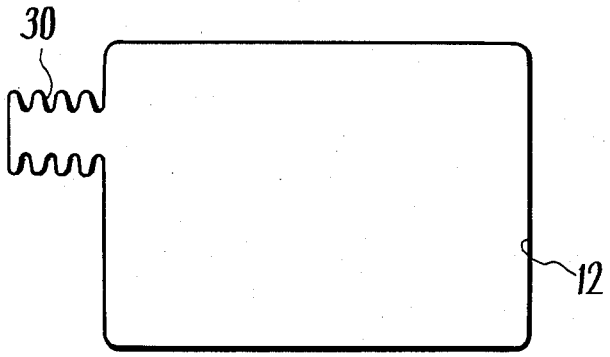
FIGS. 5 and 6 are schematic diagrams respectively used to explain spaces in which coolant is charged.

It is, in a certain case, possible that a part of space 12 is opened and bellows 30 are connected to the opening of space 12 at the inside or outside of the space 12 as shown in FIG. 5 to follow up the expansion or shrinkage of coolant 17.

Further, sponge or porous material with good heat conduction is located on the periphery of space 12, for example, on the inner surface of front cylindrical portion 9 of metal cover 7 to increase the effective contacting surface areas of metal cover 7 and coolant 17 and hence to enhance the thermal conduction.

In the above examples of the invention, the liquid coolant 17 is charged in the space 12. In a certain case, it is possible that the liquid coolant 17 is circulated and cooled at the outside of the space 12 to more effectively cool the panel 3. This can be carried out by an arrangement shown in, for example, in FIG. 6. That is, upper and lower portions of space 12 are respectively connected through paths or conduits 20 and 21 to a cooling chamber 22 which has provided with heat radiation fins 23. Valves 24 and 25 are respectively provided at the connection points between the space 12 and conduit 20 and between the space 12 and conduit 21. These valves 24 and 25 are kind of check valves so that the liquid coolant 17 circulates only in one direction from the space 12 through valve 24→ conduit 20→ cooling chamber 22→ conduit 21→ valve 25 to the space 12 and can not circulate in the opposite direction.

According to this arrangement, the coolant 17, which becomes low in specific gravity because of being heated, goes to the cooling chamber 22 through the valve 24 and conduit 20 and is cooled therein. Thus, the specific gravity of coolant 17 is increased by the cooling. The coolant 17, whose specific gravity becomes high, returns to the space 12 through the conduit 21 and valve 25. That is, the circulation of coolant 17 is automatically carried out from space 12 through the conduit 20—cooling chamber 22—conduit 21 to space 12 to increase the cooling effect.

Figure 6:
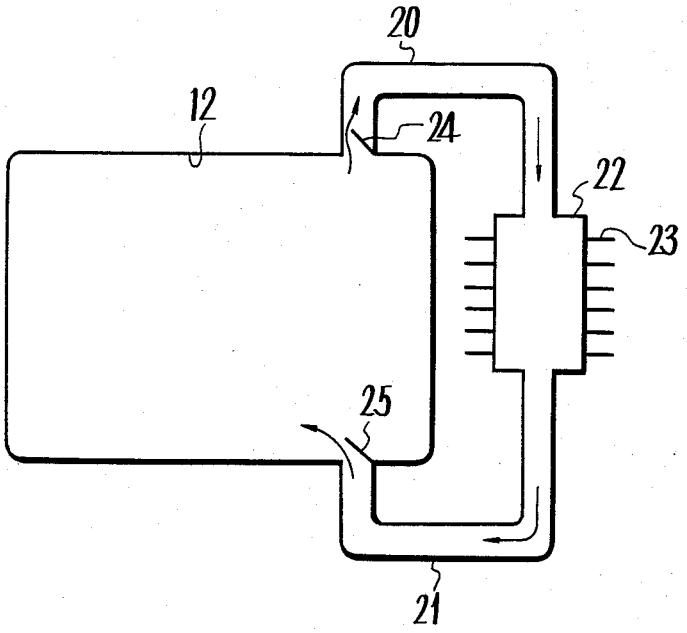

The modifications shown in FIGS. 5 and 6 can be, of course, applied to each of the examples of the invention shown in FIGS. 1 to 4.

In the above examples, liquid is used as the coolant 17, but it is needless to say that the coolant 17 is not limited to liquid.

It will be apparent that many modifications and variations could be effected by one skilled in the art without departing from the spirits or scope of the novel concepts of the present invention, so that the scope of the invention should be determined by the appended claims only.

We claim as our invention:

1. A liquid cooled cathode ray tube comprising a cathode ray tube with a transparent planar front panel coated with a phosphor screen, a metal heat radiator and spacer surrounding said planar front panel and extending outwardly therefrom, a planar transparent panel supported by said metal heat radiator a short spaced distance from said planar front panel, elastic resin between said metal heat radiator and spacer and said planar front panel and said planar transparent panel and elastically sealing said heat radiator to said planar front panel and to said planar transparent panel to form a closed sealed liquid retaining chamber, and transparent coolant selected from the group of water, benzyl alcohol, methyl benzoate, ethyl benzoate, diethyl oxalate, dibuthyl phthalate, ethylene glycol, and mixtures thereof, filling the sealed liquid retaining chamber.

2. A liquid cooled cathode ray tube according to claim 1 wherein said metal heat radiator is formed with heat radiating fins.

3. A cathode ray tube apparatus according to claim 1, wherein said metal radiator has attaching pieces to support said cathode ray tube apparatus.

4. A cathode ray tube apparatus according to claim 1, wherein said transparent coolant is a liquid having electric conductivity which is grounded to a chassis through said metal body.

* * * * *